US005263285A

United States Patent [19]

Langlois et al.

[11] Patent Number: 5,263,285

[45] Date of Patent: Nov. 23, 1993

[54] DEVICE FOR MOUNTING AN ADAPTER ON A LENS BLANK

[75] Inventors: Jean-Pierre M. F. Langlois, Rouen; Raynald G. M. Longuet, Amfreville la Campagne, both of France

[73] Assignee: Buchmann Optical Engineering, Ypres, Belgium

[21] Appl. No.: 872,169

[22] Filed: Apr. 22, 1992

[30] Foreign Application Priority Data

May 16, 1991 [FR] France ..... 91 05926

[51] Int. Cl.[5] ..... B24B 41/06

[52] U.S. Cl. ..... 51/216 LP; 51/235; 51/277

[58] Field of Search ..... 51/216 LP, 216 T, 216 P, 51/235, DIG. 15, 125, 125.5, 126, 131.5, 277, 217 L

[56] References Cited

U.S. PATENT DOCUMENTS 5,070,657 12/1991 Brule et al. ..... 51/216 LP

*Primary Examiner*—Bruce M. Kisliuk
*Assistant Examiner*—Eileen P. Morgan
*Attorney, Agent, or Firm*—Martin Smolowitz

[57] ABSTRACT

Device for mounting an adapter (18) on a lens blank (12), in particular for a lens centering machine (10). The device is of the type comprising a housing (22) in which is slidably mounted a mounting shaft (24) having an end (26) which is adapted to receive the adapter (18). The housing (22) is mounted to be movable between a position for loading the adapter (18) at the end (26) of the slidable shaft (24) and a position for mounting the adapter (18) in which the slidable shaft (24) extends in a direction (X—X) perpendicular to a support surface (P) for the lens blank (12). The device further comprises a frame (11) on which the housing (22) is mounted to be pivotable about a first pivot pin (34,Z—Z) parallel to the support surface (P) between the adapter-loading position and the adapter-mounting position, and an arrangement (50,64,72) for consecutively actuating the pivoting of the housing (22) and the sliding of the slidable shaft (24).

10 Claims, 3 Drawing Sheets

10
X X
12
R
16
14
18
48
36
Z-Z
34
38
46
50
52
54
T-T
26
62
58
56
20
60
40
22
42
44
24
Y-Y
11
32
28
30
78
68
80
76
70
74
AH
72
L1
L2
H
S-S
76

DEVICE FOR MOUNTING AN ADAPTER ON A LENS BLANK

FIELD OF THE INVENTION

The present invention relates to a device for mounting an adapter on a lens blank.

The invention more particularly relates to a device for mounting such an adapter intended for a machine for centering lenses.

BACKGROUND OF THE INVENTION

An example of such a machine for centering lenses is described and shown in the document EP-A-0 206 860. This machine mainly comprises a horizontal planar surface, such as for example a flat screen, on which rests a lens blank, and a device for mounting an adapter on the blank, the device being mounted to be movable between an adapter-loading position and an adapter-mounting position.

The device for mounting the adapter is for example constructed in accordance with the teaching of the patent application FR-A-2,613,268 and comprises a housing in which is slidably mounted a shaft whose end is arranged to receive an adapter.

When the mounting device is in position for mounting the adapter, the axis of the slidable shaft is coincident with a reference axis of the centering machine which is perpendicular to the blank support.

The user of such a machine first of all effects a precise geometrical positioning of the lens blank with respect to the reference axis, then, in a second step, brings the adapter-mounting device to the mounting position, and lastly effects the mounting proper by causing a vertical downward sliding of the slidable shaft the end of which had been loaded with an adapter.

It has been found that the mounting device which equips such a machine is not very aesthetic and is particularly large.

SUMMARY OF THE INVENTION

An object of the present invention is to provide a device for mounting an adapter on a lens blank which overcomes the aforementioned drawbacks.

To this end, the invention provides a device for mounting an adapter on a lens blank, of the type comprising a housing in which is slidably mounted a mounting shaft whose end is arranged to receive an adapter, the housing being mounted to be movable between a position for loading the adapter at the end of the slidable shaft and a position for mounting the adapter in which the slidable shaft extends in a direction perpendicular to a support surface for the lens blank, characterized in that the device comprises a frame on which the housing is mounted to be pivotable about a first pivot pin parallel to the support surface between the adapter-loading position and the adapter-mounting position, and means for consecutively actuating the pivoting of the housing and the sliding of the slidable mounting shaft.

According to other features of the invention:

the actuating means comprise a control arm having a first end mounted on the housing to be pivotable about a second pivot pin parallel to the first pivot pin and a second end articulated to a portion of the slidable shaft, an elastic return spring biasing the slidable shaft to a position in which it is retracted into the housing, means for driving in rotation the control arm about the second pivot pin to cause the pivoting of the housing, in which housing the slidable shaft is in the retracted position, and consecutively cause the sliding of the slidable shaft, in opposition to the return biasing force applied thereto by the return spring, between its retracted position and an extended position for mounting the adapter, and a fixed stop for the housing against which the housing comes to bear thereby defines the adapter-mounting position;

the means for articulating the second end of the control arm to the slidable shaft comprise a cylindrical articulation pin which extends in a direction parallel to the second pivot pin and is received between two parallel guiding and driving surfaces which are formed on the slidable shaft and extend in a plane perpendicular to the slidable shaft;

the driving means comprise a motor which is connected to the control arm by the connecting rod of a connecting rodcrank system, the connecting rod having a free end which is articulated to the control arm;

the line passing through the axis of the articulation of the free end of the connecting rod to the control arm and the second pivot pin of the control arm is substantially perpendicular to the line passing through the second pivot pin and the axis of the cylindrical guide pin;

the device comprises means for varying the torque of the driving motor;

the driving motor is a reversible electric motor whose current supply is controlled in such manner as to vary the adapter-mounting force;

the motor is controlled by means of a "fugitive" push-button switch, and the housing is pivotally mounted on the frame by means of a pivotal arm having a first end mounted to be pivotable about the first pivot pin and a second end fixed to the housing.

The invention also provides a machine for centering lenses, characterized in that it comprises a support surface on which a lens blank is placed with a precise geometrical positioning with respect to a reference axis perpendicular to the support surface for the lens, and a device for mounting an adapter which is constructed in accordance with the teaching of the present invention and is arranged on the machine in such manner that the axis of the slidable mounting shaft coincides with the reference axis when the housing is in the adapter-mounting position.

BRIEF DESCRIPTION OF THE DRAWINGS

Further features and advantages of the invention will be apparent from the following detailed description with reference to the accompanying drawings in which.

DESCRIPTION OF THE PREFERRED EMBODIMENT

The Figures illustrate a machine 10 for centering lenses or optical glasses, such as for example a blank 12 of a lens which is to be subsequently ground on a grinding machine so as to adapt it to the shape of a rim of the frame of a pair of eyeglasses in which the cut lens must be mounted with precision.

Such a machine 10 comprises a centering station 14 which mainly comprises a flat horizontal screen, whose upper side constitutes a support plane P on which rests the lens blank 12 to be centering.

Figure 2:
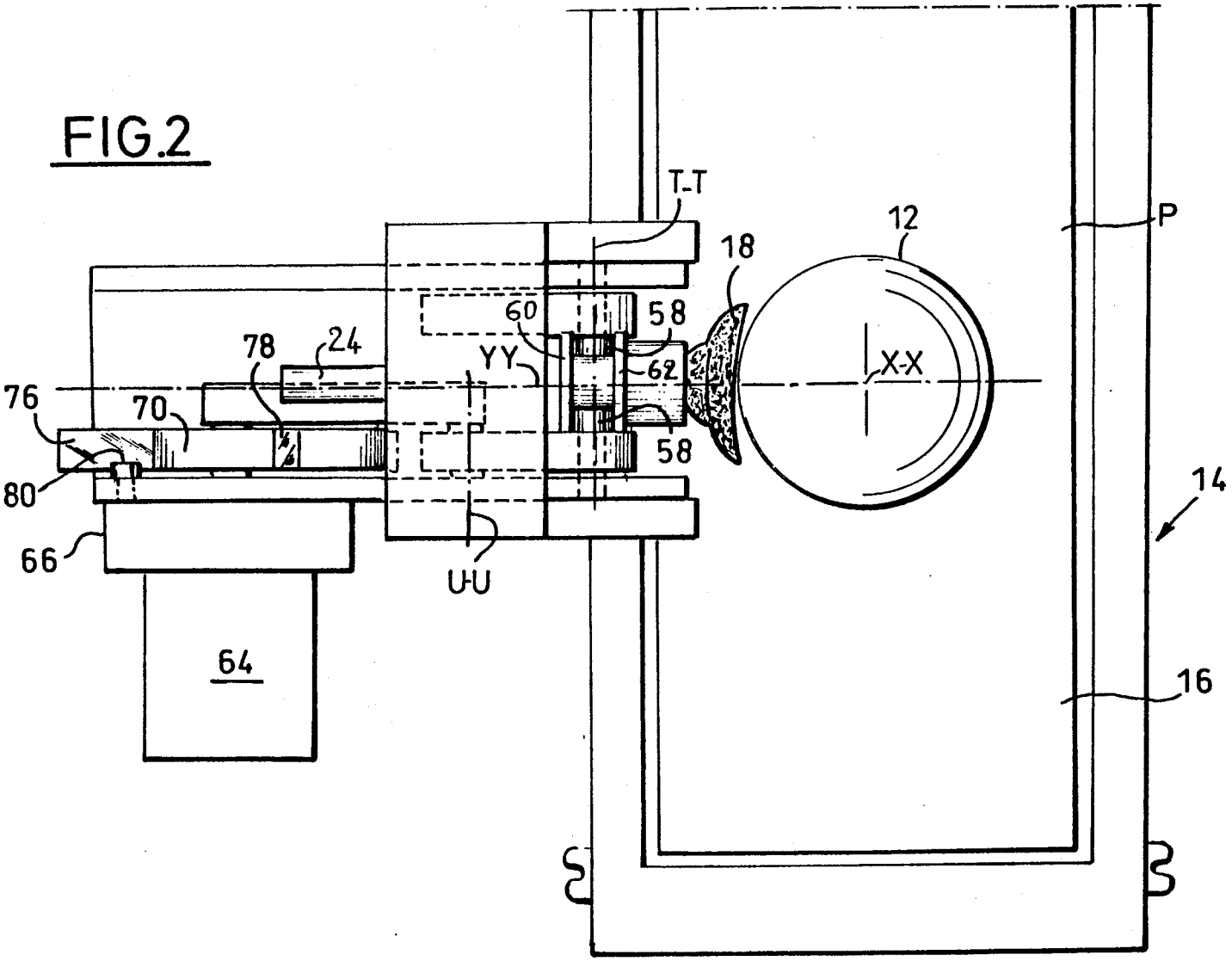
FIG. 2 is a top plan view of the machine illustrated in FIG. 1.

The blank centering operation has essentially for purpose to achieve a precise positioning of the blank 12 with respect to a reference axis X—X which is perpendicular to the support plane P, and whose trace on the screen 16 is for example illustrated by two intersecting lines as shown in FIG. 2.

After having precisely centred the blank 12, an adapter 18 must be mounted on the lens blank 12 in order to subsequently shape the blank in a grinding machine (not shown).

The operation for its mounting the adapter or sucker 18, also termed "sucker mounting operation", has for purpose to apply the adapter or sucker 18 in a precise manner and with a controlled force on the top side of the glass lens blank 12.

To this end, the adapter 18 is mounted in a mounting device 20 mainly comprising a housing 22 and a slidable shaft 24 whose free end 26 is arranged to receive the adapter 18.

As to the operation of these components of the device for mounting the adapter 18, reference may be made to the document FR-A-2,613,268 the disclosure of which is included in specification by this reference.

Figure 1:
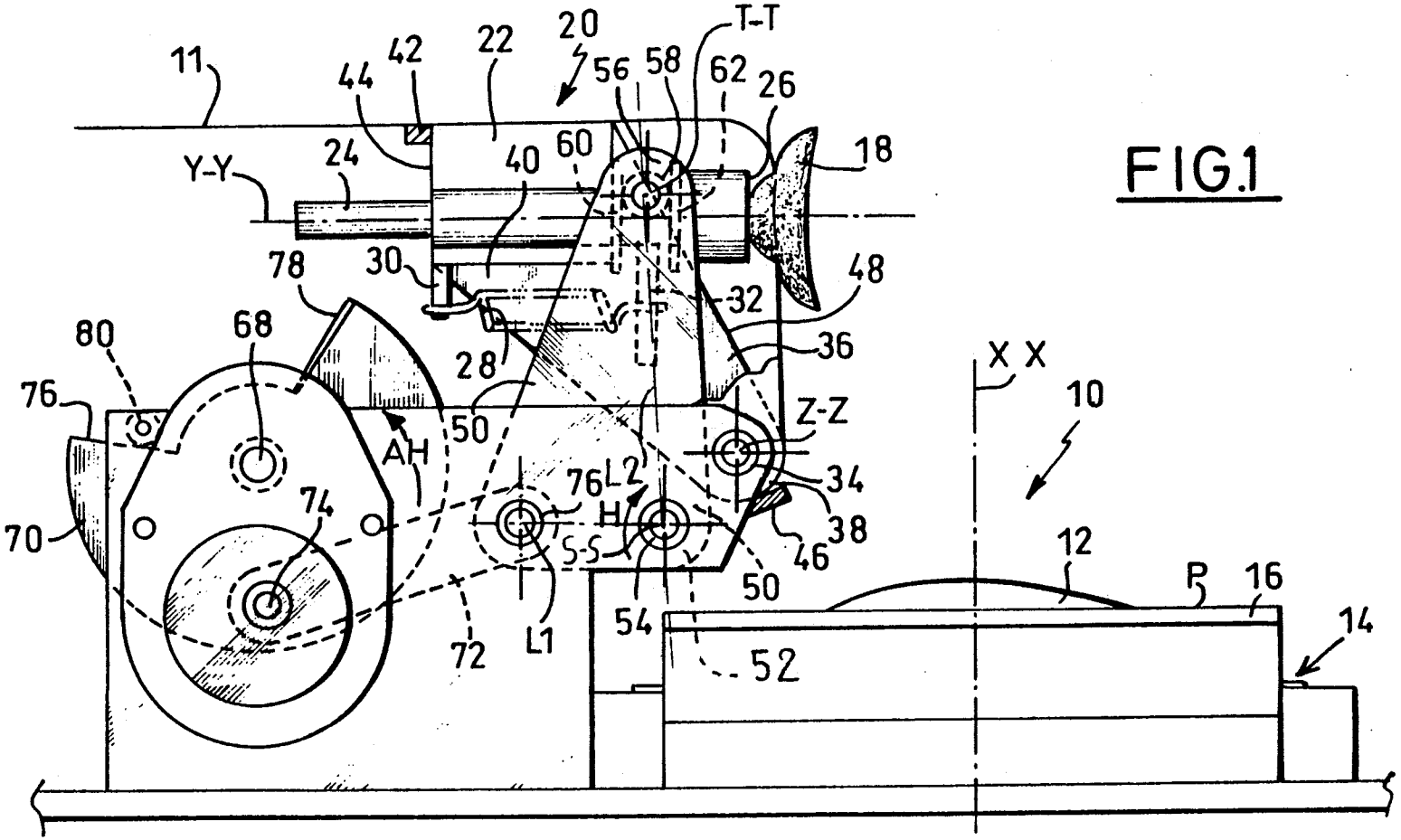
FIG. 1 is a simplified diagrammatic view of a machine for centering lenses or optical glasses, equipped with a device for mounting an adapter according to the teaching of the invention and illustrated in the position for loading the adapter.
Figure 3:
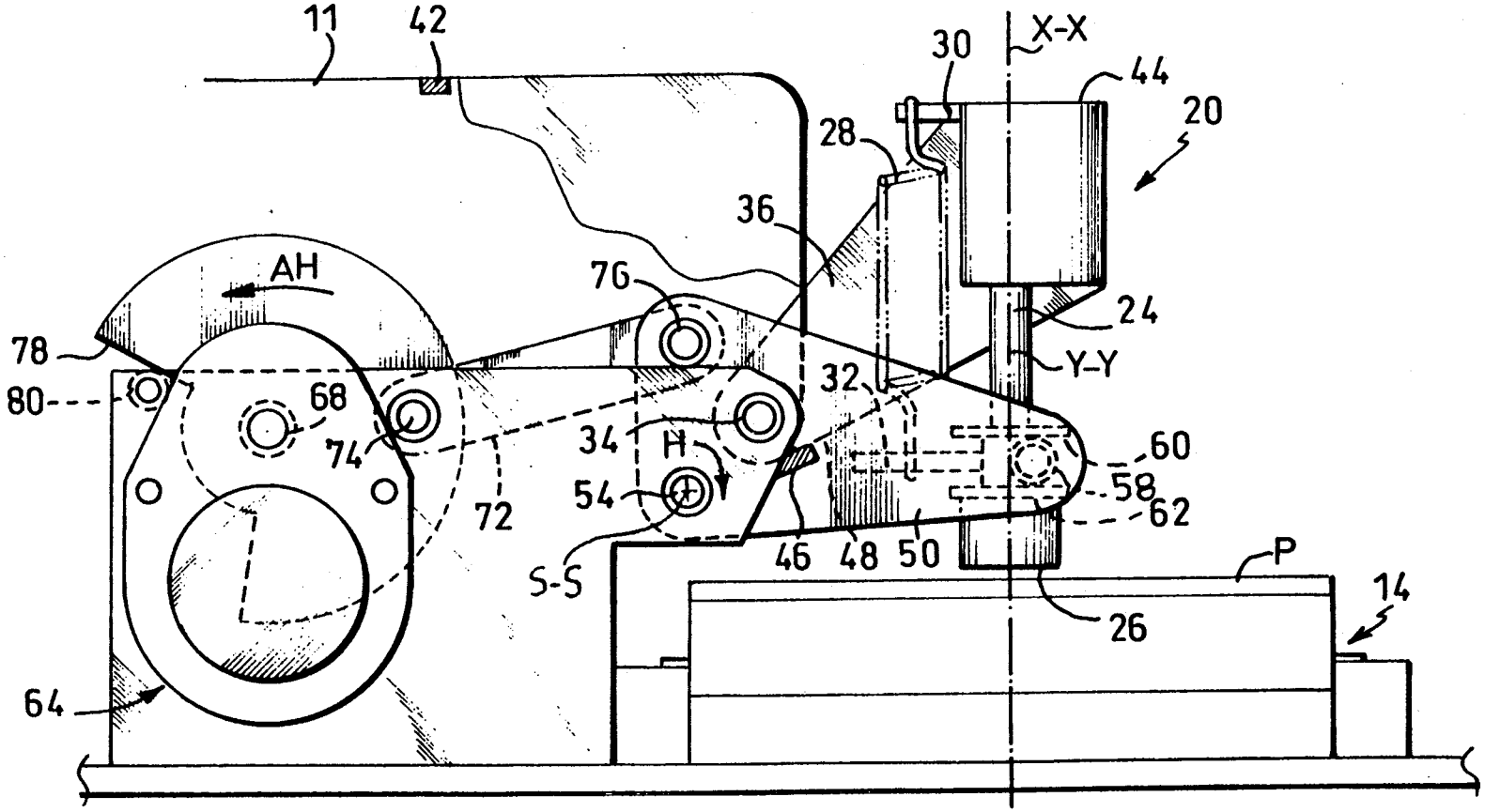
FIG. 3 is a view similar to FIG. 1 in which the device for mounting the adapter is illustrated in the extended position for mounting the adapter.

To summarize, the shaft 24 is mounted in the housing 22 to be slidable in the direction Y—Y between a retracted position of the shaft 24 relative to the housing 22, as shown in FIGS. 1 and 2, and an adapter-mounting position in which the mounting shaft 24 is partly extended out of the housing 22 in the direction Y—Y, as shown in FIG. 3.

The slidable shaft 24 is elastically biased to its retracted position illustrated in FIGS. 1 and 2 by a helical tension spring 28, whose ends are respectively hooked to a lug 30 on the housing 22 and to a lug 32 fixed to the shaft 24.

In order to make it easy to use the lens centering machine 10, the whole of the mounting device 20 must be movable relative to the centering station 14 between a position for loading an adapter 18 illustrated in FIGS. 1 and 2, and an active adapter-mounting second position illustrated in FIG. 3.

Indeed, in the adapter-loading position, apart from the fact that it must be possible to have ready access to the free end 26 of the slidable mounting shaft 24 for loading an adapter 18, the space above the support surface P must be unobstructed so that the user can easily carry out the geometrical centering of the lens blank 12, for example by means of a sighting device (not shown in the drawings).

According to the invention, the adapter-mounting device 20 is completely withdrawn from the upper region of the centering station 14 to the first position for loading adapters, as illustrated in FIGS. 1 and 2 in which the main components of the device, in particular the housing 22, are substantially completely located on the left side as viewed in FIG. 1 outside the station 14.

Indeed, the housing 22 is mounted relative to the frame part 11 of the machine 10 to pivot about a first pivot means or pin 34.

The housing 22 is fixed between two identical pivotal arms 36 which have first ends 38 mounted to be pivotable about the pin 34 and second ends 40 fixed to the housing 22.

The fork mounting of the housing 22 between its two pivotal arms 36 therefore allows the housing to pivot about an axis Z—Z which is perpendicular to the reference axis X—X and to the axis Y—Y along which the mounting shaft 24 is slidable.

The pivoting of the housing 22 about the pin 34 is defined by a first fixed stop 42 for the housing 22, which defines the adapter loading first position illustrated in FIG. 1, and a second fixed stop 46 which cooperates with a front edge 48 of one of the two pivotal, arms 36 so as to define the adapter-mounting second position illustrated in FIG. 3.

In the embodiment illustrated in the Figures, the housing 22 pivots about 90° angle between its two positions defined by the stops 42 and 46.

The arrangement illustrated in the Figures further comprises two parallel arms 50, which consecutively actuate or bring about the pivoting of the housing 22 and then the sliding of the mounting shaft 24.

The two control arms 50 are mounted in the manner of a fork on each side of the pivotal arms 36. The first end 52 of each control arm 50 is mounted to be pivotable about a second pivot means or pin 54, whose axis S—S is parallel to the axis Z—Z of the first pivot pin 34. The second end 56 of each control arm 50 includes a cylindrical driving and guiding pin 58 whose axis T—T is parallel to the axes Z—Z and S—S.

The two cylindrical pins 58 are received between two guiding and driving plates 60 and 62 formed on the slidable mounting shaft 24. The two plates 60 and 62 are parallel to each other and perpendicular to the axis Y—Y along which the slidable shaft 24 is slidable.

The means for driving the control arms 50 in rotation about the pivot pin 54 will now be described. These driving means comprise an electric motor 64 provided with a speed reducer 66 the output shaft 68 of which is parallel to the pivot pin 54 and drives in rotation a member 70 in the shape of a circular sector.

The member 70 is the crank of a connecting rod-crank system which is completed by a driving connecting rod 72, which has a first end articulated to the crank 70 by a first pivot pin 74 and a second end which is articulated to one of the control arms 50 by a second pivot pin 76, whose axis U—U is parallel to the axes S—S and T—T.

The line L1 which passes through the axes S—S and U—U is substantially perpendicular to the line L2 which passes through the axes S—S and T—T.

The member 70 constituting the driving crank has an incomplete circular sector shape as shown in FIGS. 1 and 2. For this purpose, it defines two radial surfaces 76 and 78 which define therebetween an empty angular sector capable of alternately cooperating with a fixed stop 80 constituted by a cylindrical stud fixed to the frame 11 of the machine 10.

The operation of the mounting device 20 will now be described.

Starting at the loading position illustrated in FIGS. 1 and 2, and after having loaded an adapter 18 on the end 26 of the slidable mounting shaft 24, the user causes, by control means (not shown), the crank 70 to be driven in rotation by the motor 64 in the counterclockwise direction AH shown in the Figures.

The rotation of the crank 70 drives the connecting rod 72 upwardly from its position shown in FIG. 1 to its position shown in FIG. 3. The motion of the connecting rod 72 first of all pivots the control arms 50 about the pin 54 in the clockwise direction H shown in FIGS. 1 and 2.

The pivoting of the control arms 50 results in a corresponding displacement in the clockwise direction of the driving pins 58, which describe an arc of a circle of about 90° between the loading position illustrated in FIG. 1 and the adapter-mounting position illustrated in FIG. 3.

Owing to the force exerted by the return spring 28, and in a first stage of the pivoting of the arms 50, the driving pins 58 simultaneously drive the slidable shaft 24 and the housing 22 in which the shaft remains in its retracted position.

In the course of this first stage, this assembly therefore pivots in the clockwise direction about the pivot pin 34 until the front edge 48 of one of the pivotal arms 36 of the housing 22 abuts against the fixed stop 46, which defines the adapter-mounting position of the housing 22 illustrated in FIG. 3.

The pivoting of the control arms 50 in the clockwise direction continues under the action of the force applied thereto by the connecting rod 72 and the driving pins 58, and this causes in this second stage the slidable mounting shaft 24 to extend out of the housing 22 in opposition to the elastic return force applied to the shaft 24 by the helical tension spring 28.

This second stage of the rotation of the control arms 50 therefore consecutively brings about the vertical movement of the slidable mounting shaft 24 relative to the housing 22, until the adapter 18 comes into contact with the top surface of the blank 12.

For a description of the mechanism whereby it is possible to release the adapter 18 from the end 26 of the slidable mounting shaft 24, reference may be for example made to the aforementioned document FR-A-2,613,268.

As illustrated in FIG. 3, the mounting device 20 is of course arranged in the machine 10 in such manner that, in the adapter-mounting position, the axis Y—Y along which the slidable mounting shaft 24 is slidable is coincident with the reference axis X—X of the centering station 14.

The motor 64 is for example an electric motor which is controlled by means of its electric current so as to permit adjusting the force with which the adapter 18 is mounted on the blank 12.

The motor 64 is for example controlled by a push-button switch which must be maintained in position, also termed a "fugitive" switch, which immediately causes the driving motor 64 to rotate in the opposite direction when it is released. This rearward motion will continue until the abutment surface 76 abuts against the stop pin 80.

The fact that the user must maintain the push-button depressed for effecting a mounting operation is a safety measure against risk of pinching the hands in the mechanism and also avoids applying an excessively prolonged force on the glass blank which is fragile.

The means for controlling the supply of electric current to the motor 64 may also include means for timing the starting up of the motor 64.

The device has been illustrated in FIG. 3 in the case where there is no lens blank 12 on the support surface P.

In order to ensure that the end 26 of the slidable shaft 24 does not damage the upper surface of the screen 16, the abutment surface 78 is arranged to abut against the stop pin 80 and thereby stop an excessive pivoting of the control arms 50 in the clockwise direction H.

The various movements of the components of the device, when the direction of rotation of the motor 64 is reversed after the adapter 18 has been mounted, occur in the direction opposed to those described for the adapter-mounting stage until the upper surface 44 of the housing 22 once again abuts against the fixed stop 42 on the frame 11.

The teaching of the invention therefore provides an automatic adapter-mounting device which is particularly compact and may be substantially completely withdrawn into a frame 11 which may be provided with a cover (not shown) and which does not hinder the user in the initial blank-centering stage and results in a particularly aesthetic design of the centering machine 10. Notwithstanding this considerable compactness, the device according to the invention nonetheless ensures a rectilinear travel of the slidable mounting shaft 24 of the order of 25 to 30 mm, and mounts without any risk an adapter 18 on the lens blanks whose thicknesses may vary between 3 and 18 mm.

In the adapter-loading position illustrated in FIGS. 1 and 2, it will be observed that the end 26 of the slidable mounting shaft 24 is in a position in which it is particularly easy for the user to load an adapter 18.

What is claimed is:

1. Device for mounting an adapter on a lens blank carried by a support surface, said device comprising a frame, a housing pivotably attached to said frame, a mounting shaft mounted in said housing, said shaft being slidable along an axis and having a first end arranged to receive an adapter, a first pivot means mounting said housing on said frame, said housing being pivotable between an adapter-loading first position for loading said adapter on said first end of said shaft and an adapter-mounting second position for mounting said adapter on said lens blank, in which in said adapter-mounting second position, said shaft extends in a direction perpendicular to said support face, and actuating means for consecutively actuating said pivoting of said housing and said sliding of said shaft for mounting said adapter on the lens blank.

2. Device according to claim 1, wherein said actuating means comprise a control arm having a first end and a second end opposed to said first end, second pivot means parallel to said first pivot means mounting said first end of said control arm on said housing to be pivotable about said second pivot means, means for articulating said second end of said control arm to said shaft, an elastic return spring cooperative with said shaft for biasing said shaft to a retracted position in which said shaft is retracted into said housing, means for driving in rotation said control arm about said second pivot means to cause said pivoting of said housing, and to consecutively cause said sliding of said shaft, in opposition to the biasing action of said return spring, between said retracted position of said shaft and an extended position of said shaft for mounting said adapter on said lens blank, and a fixed stop cooperative with said housing against which stop said housing is adapted to come to bear for defining said adapter-mounting position.

3. Device according to claim 2, wherein said means for articulating said second end of said control arm to said shaft comprise a cylindrical articulation pin which extends in a direction parallel to said second pivot means, and two parallel guiding and driving surfaces which are formed on said shaft and extend in planes perpendicular to said shaft, said cylindrical articulation pin being engaged between said two parallel guiding and driving surfaces.

4. Device according to claim 3, wherein said driving means comprise a motor, a connecting rod-crank system, said motor being drivingly connected to said crank, and said connecting rod having an end articulated to said crank and an opposite end articulated to said control arm, a line passing through said articulation of said connecting rod to said control arm and through said second pivot means being substantially perpendicular to a line passing through said second pivot means and through said cylindrical guide pin.

5. Device according to claim 2, wherein said driving means comprise a motor, a connecting rod-crank system, said motor being drivingly connected to said crank, and said connecting rod having an end articulated to said crank and an opposite end articulated to said control arm.

6. Device according to claim 5, further comprising means for varying the torque of said driving motor.

7. Device according to claim 6, wherein said motor is a reversible electric motor, said motor receiving a current controlled in such manner as to vary the force mounting said adapter on said blank.

8. Device according to claim 5, wherein said motor is controlled by means of a fugitive push-button switch.

9. Device according to claim 1, comprising a pivotal arm having a first end fixed to said housing and a second end pivotally mounted on said first pivot means for pivotally mounting said housing on said frame.

10. Machine for centering lenses, comprising a support surface for carrying a lens blank and achieving a precise geometrical positioning of said lens blank with respect to a reference axis perpendicular to said support surface, and a device for mounting an adapter on said lens blank carried by said support surface, said device comprising a frame, a housing pivotably attached to said frame, a mounting shaft mounted in said housing, said shaft being slidable along an axis and having a shaft first end arranged to receive an adapter, a first pivot means mounting said housing on said frame, said housing being pivotable between an adapter-loading first position for loading an adapter on said first end of said shaft and an adapter-mounting second position for mounting said adapter on said lens blank, in which in said adapter-mounting second position, said shaft extends in a direction perpendicular to said support surface, and means for consecutively actuating said pivoting of said housing and said sliding of said shaft, said device being arranged on said machine in such manner than said axis along which said shaft is slidable coincides with said reference axis when said housing is in said adapter-mounting second position.

* * * * *